United States Patent [19]

Ando

[11] Patent Number: 4,876,974

[45] Date of Patent: Oct. 31, 1989

[54] SNAP FIT PRESSER FOOT ASSEMBLY FOR A SEWING MACHINE

[75] Inventor: Manabu Ando, Asou, Japan

[73] Assignee: Kohshin Seimitsu Kikai Kabushiki Gaisha, Tokyo, Japan

[21] Appl. No.: 288,231

[22] Filed: Dec. 22, 1988

[30] Foreign Application Priority Data

Jan. 5, 1988 [JP] Japan ..... 63-470

[51] Int. Cl.[4] ..... D05B 29/00

[52] U.S. Cl. ..... 112/240

[58] Field of Search ..... 112/240, 235

[56] References Cited

U.S. PATENT DOCUMENTS 4,178,865 12/1979 Odermann et al. ..... 112/240 X 4,213,411 7/1980 Knowles ..... 112/240

4,736,697 4/1988 Hanyu et al. ..... 112/240

*Primary Examiner*—Andrew M. Falik

*Attorney, Agent, or Firm*—Jones, Tullar & Cooper

[57] ABSTRACT

A presser foot assembly in a sewing machine essentially comprising a presser foot having a catch pin plateau integrally connected to its cambered press plate and a holder which is adapted to be fixed to the body of the sewing machine. The holder has a curved front extension, and this curved front extension has a lateral and longitudinal slot in its bottom to snugly accommodate the catch pin plateau of the press plate, permitting the free inclination of the presser foot about its pivot within so controlled limits that the needle cannot come to contact to the edge of the needle aperture of the press plate.

1 Claim, 2 Drawing Sheets

SNAP FIT PRESSER FOOT ASSEMBLY FOR A SEWING MACHINE

BACKGROUND OF THE INVENTION

1. Field of the Invention

The present invention relates to a presser foot assembly in a sewing machine, essentially comprising a presser foot and a holder which detachably holds the presser foot.

2. Description of Prior Art

Japanese utility Model Publication No. 57-20143 shows a presser foot as having two opposite rises integrally connected to its press plate and a catch pin inserted in the apertures of the rises to span the inner space between the opposite rises. This structure requires two subsequent manufacturing steps, that is, a first step in which two opposite rises are integrally connected to the press plate; and a second step in which a catch pin is inserted in the apertures of the rises. This causes an increase of manufacturing cost, and still disadvantageously opposite rises are bent or broken from time to time when catch pins are inserted in the apertures of the opposite rises.

Also, when the presser foot assembly is raised above the cloth, the presser foot rotates about its pivot to lower or raise its tip, thereby causing the edge of its needle aperture to catch and sometimes break or bend the needle when undesired force is applied to the presser foot.

SUMMARY OF THE INVENTION

With the above in mind one object of the present invention is to provide a presser foot assembly whose structure permits the presser foot to be made in a single step. This will be advantageous to mass production and reduction of the manufacturing cost.

Another object of the present invention is to provide a presser foot assembly whose structure permits the presser foot to incline about its pivot within controlled limits, thereby eliminating the possibility of causing the needle to contact to the edge of the needle aperture.

To attain these objects a presser foot assembly in a sewing machine according to the present invention comprises: a presser foot comprising a cambered press plate having a needle aperture, a guide rise located behind the needle aperture and integrally connected to the upper surface of the cambered press plate, opposite side extensions integrally connected to the opposite side edges of the top of the guide rise and a catch pin integrally connected to the front of the top of the guide riser and extending laterally beyond the opposite side extensions; and a holder which is adapted to be fixed to the body of the sewing machine, said holder having a curved front extension, which curved front extension has a lateral and longitudinal slot to define two opposite resilient pieces and a fitting space which fitting space is wide enough to permit the insertion of the opposite side extensions of the guide rise, and is high or large in vertical dimension, compared with the thickness of the opposite side extensions of the guide rise, and further said curved front extension having two opposite recesses facing the opposite resilient pieces to permit the catch pin to snap in the spaces defined by the recesses and the underlying opposite resilient pieces, allowing said presser foot to freely incline about its pivot within controlled limits.

The presser foot is pushed against the holder with the riser of the presser foot inserted in the inner space between the opposite resilient pieces of the holder and with the opposite side extensions of the riser inserted in the lateral enlarged space of the holder, which lateral enlarged space is consecutive to the inter space between the opposite resilient pieces of the holder. Then, the opposite resilient pieces of the holder yieldingly lower until the catch pin is snapped in the space defined by the recesses and the underlying resilient pieces, and at the same time, the opposite side extensions of the riser is loosely fitted in the enlarged lateral space of the holder. The presser foot can incline about its pivot within so controlled limits that the needle cannot come to contact to the edge of the needle aperture of the press plate.

The integral connection of a lateral catch pin to the riser of the runner plate permits the use of a separate mold (comprising upper and lower half molds) to make the presser foot, thus requiring only a single step for making the presser foot.

Other objects and advantages of the present invention will be understood from the following descripition of a presser foot assembly according to one embodiment of the present invention, which is shown in accompanying drawings.

DESCRIPTION OF THE PREFERRED EMBODIMENT

Figure 1:
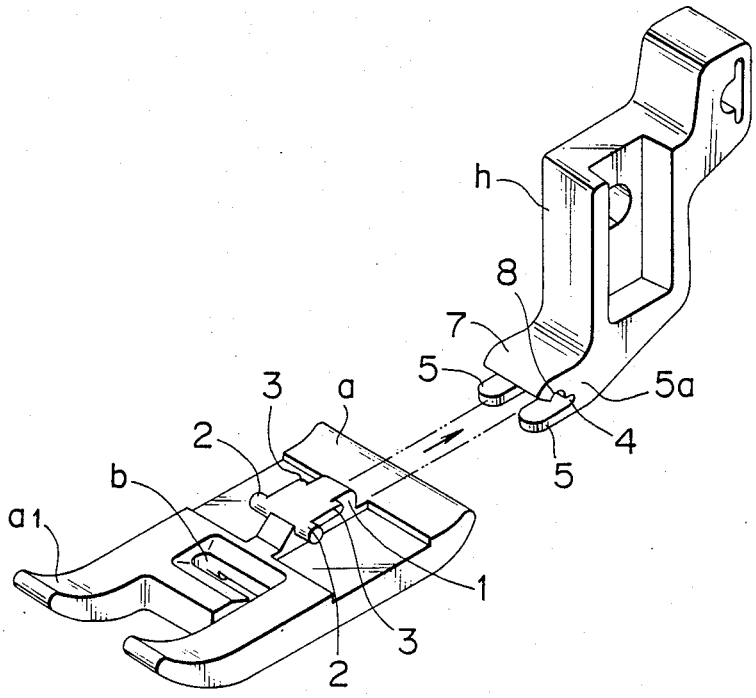
FIG. 1 is a perspective view of a presser foot and an associated holder.
Figure 2:
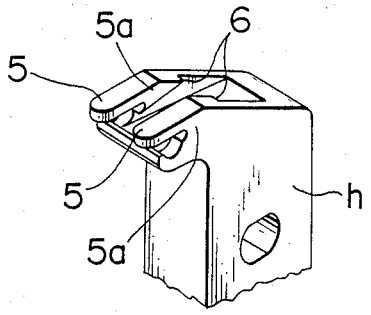
FIG. 2 is a perspective view of the holder upside down.
Figure 3:
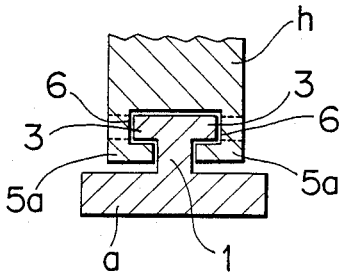
FIG. 3 is a sectional view of the presser foot assembly taken at a place at which the presser foot and the holder are jointed together.

Referring to FIGS. 1 and 2, a presser foot assembly is shown as essentially comprising a presser foot and an associated holder "h". The presser foot "a" is shown as comprising a press plate having a bifurcate rising front a1. It has a needle aperture "b", a guide rise 1 located behind the needle aperture "b" and integrally connected to the upper surface of the press plate, opposite side extensions 3, 3 integrally connected to the opposite side edges of the top of the guide rise 1 and a catch pin 2 integrally connected to the front of the top of the guide riser 1 and extending laterally beyond the opposite side extensions 3, 3.

The holder "h" is adapted to be fixed to the body of the sewing machine. The holder "h" has a curved front extension. This curved front extension has a lateral and longitudinal slot 4, 6 to define two opposite resilient pieces 5, 5 and a fitting space. This fitting space is wide enough to perimit the insertion of the opposite side extensions 3, 3 of the guide rise 1, and is high or large in vertical dimension, compared with the thickness of the opposite side extensions 3, 3 of the guide rise 1.

Thus, the opposite side extensions 3, 3 of the guide rise 1 can freely move in the enlarged lateral space when the presser foot is jointed to the holder. Also, the curved front extension has two opposite semicircular recesses 8, 8 facing the opposite resilient pieces 5, 5 extending from the holder base 5*a* to permit the laterally extending portion catch pin 2 to snap in the spaces defined by the semicircular recesses 8, 8 and the underlying opposite resilient pieces 5, 5, allowing the presser foot to freely incline about its pivot within controlled limits.

The presser foot "a" and the holder "h" are manufactured from metal or plastic molds.

Figure 4:
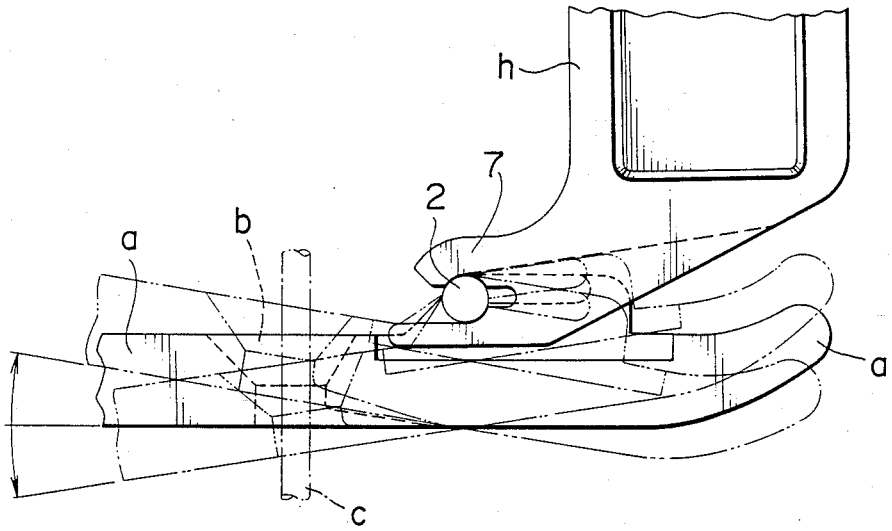
FIG. 4 is a side view of the presser foot assembly to show the movement of the presser foot with respect to the holder.

In assembling the presser foot "a" and the holder "h" the presser foot "a" is pushed against the holder "h" with the riser 1 of the presser foot "a" inserted in the inner space between the opposite resilient pieces 5, 5 of the holder "h" and with the opposite side extensions 3, 3 of the riser 1 inserted in the lateral enlarged space 6, 6, which is consecutive to the inner space between the opposite resilient pieces 5, 5 of the holder "h". Then, the opposite resilient pieces of the holder yieldingly lower until the catch pin 2, 2 is snapped in the space defined by the semicircular recesses 8, 8 and the underlying resilient pieces 5, 5 and at the same time, the opposite side extensions 3, 3 of the riser 1 is loosely fitted in the enlarged lateral space of the holder "h". The presser foot "a" can incline about its pivot within such controlled limits that the needle "c" cannot come to contact to the edge of the needle aperture "b" of the press plate, as seen from FIG. 4.

The integral connection of a lateral catch pin 2 to the riser 1 of the press plate permits the use of a separate mold (comprising upper and lower half molds) to make the presser foot "a", thus requiring only a single step for making the presser foot.

What is claimed is:

1. A presser foot assembly in a sewing machine comprising:

a presser foot "a" comprising a cambered press plate having a needle aperture "b", a guide rise 1 located behind the needle aperture "b" and integrally connected to an upper surface of the cambered press plate "a", opposite side extensions 3, 3 integrally connected to the opposite side edges of a top surface of the guide rise 1 and a catch pin 2 integrally connected to a front portion of the top of the guide riser 1 and extending laterally beyound the opposite side extensions 3, 3; and a holder "h" which is adapted to be fixed to a body of the sewing machine, said holder "h" having a curved front extension, which curved front extension has a lateral and longitudinal slot 4, 6 to define two opposite resilient pieces 5, 5 and a fitting space, which fitting space is wide enough to perimit the insertion of the opposite side extensions 3, 3 of the guide rise 1, and is high or large in vertical dimension, compared with the thickness of the opposite side extensions 3, 3 of the guide rise 1, and further said curved front extension having two opposite recesses 8, 8 facing the opposite resilient pieces 5, 5 to permit the catch pin extending portion 2 to snap in the spaces defined by the recesses 8, 8 and the underlying opposite resilient pieces 5, 5 allowing said presser foot to freely incline about its pivot within controlled limits.

* * * * *